United States Patent [19]

Hanzawa et al.

[11] Patent Number: 4,667,556

[45] Date of Patent: May 26, 1987

[54] ELECTRONIC MUSICAL INSTRUMENT WITH WAVEFORM MEMORY FOR STORING WAVEFORM DATA BASED ON EXTERNAL SOUND

[75] Inventors: Kohtaro Hanzawa; Shigenori Morikawa; Hiroshi Morokuma; Hiroyuki Sasaki, all of Tokyo, Japan

[73] Assignee: Casio Computer Co., Ltd., Tokyo, Japan

[21] Appl. No.: 760,291

[22] Filed: Jul. 29, 1985

[30] Foreign Application Priority Data

Aug. 9, 1984 [JP] Japan ..... 59-167119

[51] Int. Cl.[4] ..... G10H 7/00; G10H 3/00

[52] U.S. Cl. ..... 84/1.01; 84/1.28

[58] Field of Search ..... 84/1.01, 1.28, 1.03, 84/462, DIG. 21

[56] References Cited

U.S. PATENT DOCUMENTS

| | | | |
|---|---|---|---|
| 3,539,701 | 11/1970 | Milde | 84/1.28 |
| 3,652,776 | 3/1972 | Milde, Jr. | 84/1.28 |
| 4,433,434 | 2/1984 | Mozer | 84/1.01 |
| 4,435,831 | 3/1984 | Mozer | 84/1.01 |
| 4,463,650 | 8/1984 | Rupert | 84/1.24 |
| 4,614,983 | 9/1986 | Usami | 84/1.01 |

FOREIGN PATENT DOCUMENTS

| | | |
|---|---|---|
| 2637063 | 3/1977 | Fed. Rep. of Germany . |
| 3330715 | 3/1984 | Fed. Rep. of Germany . |
| 1460624 | 1/1977 | United Kingdom . |
| 2023955 | 1/1980 | United Kingdom . |

*Primary Examiner*—S. J. Witkowski
*Assistant Examiner*—David Warren
*Attorney, Agent, or Firm*—Frishauf, Holtz, Goodman & Woodward

[57] ABSTRACT

A CPU supplies data write and read commands to only an address control section, and the address control section then designates, for the purpose of writing and reading data, addresses of a waveform memory in which external sound waveform data is stored.

17 Claims, 8 Drawing Figures

ELECTRONIC MUSICAL INSTRUMENT WITH WAVEFORM MEMORY FOR STORING WAVEFORM DATA BASED ON EXTERNAL SOUND

BACKGROUND OF THE INVENTION

This invention relates to an electronic musical instrument of the type in which externally fed piano or like sounds are converted into a digital waveform signal which is stored in a memory, sounds having various waveforms being obtained thereby through control of the addressing of the memory.

Heretofore, an electronic musical instrument has been developed in which a tone of, for instance, C1, obtained by depressing a C1 key of a piano, is converted through a microphone into a C1 tone signal which is A/D converted into a PCM digital signal to be stored in a waveform memory. In order to effectively use the memory area of the waveform memory, the operation of storing the PCM digital signal in the waveform memory is started simultaneously with the depression of a note key such as the C1 note key. With this arrangement, however, it is likely that a leading, rising portion of the piano tone fails to be stored. To overcome this drawback, the operation of storing data in the waveform memory may be started before the key depression. In this case, however, it is necessary to use a waveform memory having a large capacity, leading to a cost increase.

Meanwhile, in the prior art electronic musical instrument noted above, the waveform data stored in the waveform memory is read out under control by a DMAC (direct memory access controller), and waveform data is DMA transferred from the waveform memory to a FIFO (first in first out) buffer every time a key on the keyboard is operated. The waveform data stored in the FIFO buffer is fed to a D/A converter according to the output of a VCO, which provides a frequency signal corresponding to the note of the depressed key, whereby a tone having a predetermined pitch is obtained. The DMA transfer of the waveform data from the waveform memory to the FIFO buffer is done under control of a CPU. In a polyphonic electronic musical instrument where signals are processed through time division basis processing, therefore, the CPU is used exclusively for the DMA processing, such that it can devote insufficient time to other processing.

Further, the polyphonic electronic musical instrument noted above requires pluralities of VCOs, FIFO buffers, D/A converters, etc., so that its price is inevitably high.

SUMMARY OF THE INVENTION

The object of the invention is to provide an electronic musical instrument in which the processing time required by the CPU for the writing and reading of externally fed tones can be reduced, with external sound signals being efficiently and accurately stored in a waveform memory of a simple circuit construction.

According to the invention, there is provided an electronic musical instrument which comprises means for digital-to-analog conversion of an external sound signal into a digital waveform signal, a memory for storing the digital waveform signal, an address control logic means for designating memory addresses for writing and reading the digital waveform signal, and control means for supplying to the address control logic circuit means record and reproduce commands for writing and reading the digital waveform signal in and from the memory.

DETAILED DESCRIPTION OF THE PREFERRED EMBODIMENTS

Figure 1:
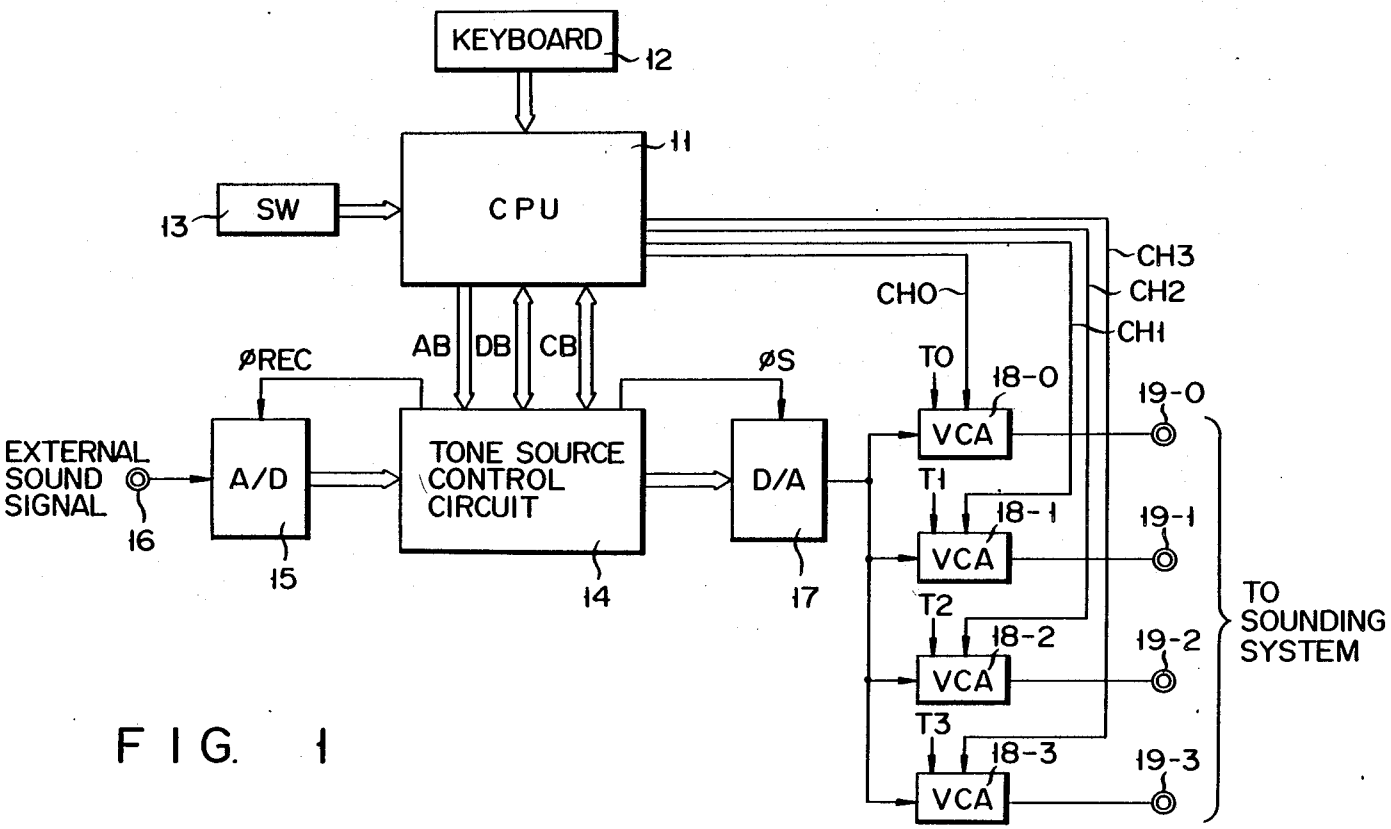
FIG. 1 is a block diagram showing an embodiment of the invention.

FIG. 1 shows the overall construction of an embodiment of the present invention. A CPU 11 produces key input signals by detecting the operation of performance keys on a keyboard 12, and it also receives switch input signals provided through operation of switches in a control switch section 13. The control switch section 13 includes a record switch and a reproduce switch, the outputs of these switches being fed as control signals to the CPU 11. An address bus AB, a data bus DB and a control bus CB are connected at one end to the CPU 11 and at the other end to a tone source control circuit 14 which effects recording and reproduction of tones.

An external sound signal is fed through an input terminal 16 to an analog-to-digital (A/D) converter 15 to obtain a digital waveform signal which is fed to the tone source control circuit 14. The input terminal 16 may be connected to, for instance, a microphone so that a note signal of, for instance, the note C1, obtained when a corresponding performance key of a piano is depressed, can be fed as an external sound signal to the A/D converter 15. The tone source control circuit 14 feeds a sampling clock signal $\phi_{REC}$ to the A/D converter 15. The external sound signal is sampled by the A/D converter 15, and the amplitude level of the sampled external sound signal is PCM converted to a digital waveform signal.

The output signal of the A/D converter 15 is stored in a waveform memory provided in the tone source control circuit 14 under the control of an address control section operable under the control of commands from the CPU 11. The waveform data stored in the waveform memory is read out according to the output from an address control section and converted, in a D/A converter 17, into an analog signal according to a waveform read clock $\phi_S$ from the tone source control circuit 14, the analog signal being fed to four VCAs 18-0 to 18-3 having a four-tone polyphonic structure. Four-channel time division timing signals T1 to T3 are fed as enable signals to gates (not shown) provided in an input stage of the VCAs 18-0 to 18-3. The output of the D/A converter 17 is fed to the VCAs 18-0 to 18-3 through their respective gates during corresponding channel periods. Further, the CPU 11 feeds channel switching signals CH0 to CH3 to the VCAs 18-0 to 18-3, a tone signal being provided from only a designated channel. The tone signal thus provided is fed from one of the corresponding channel output terminals 19-0 to 19-3 to a sound system having an amplifier, a loudspeaker, etc. (not shown), from which the corresponding tone is produced.

Figure 2:
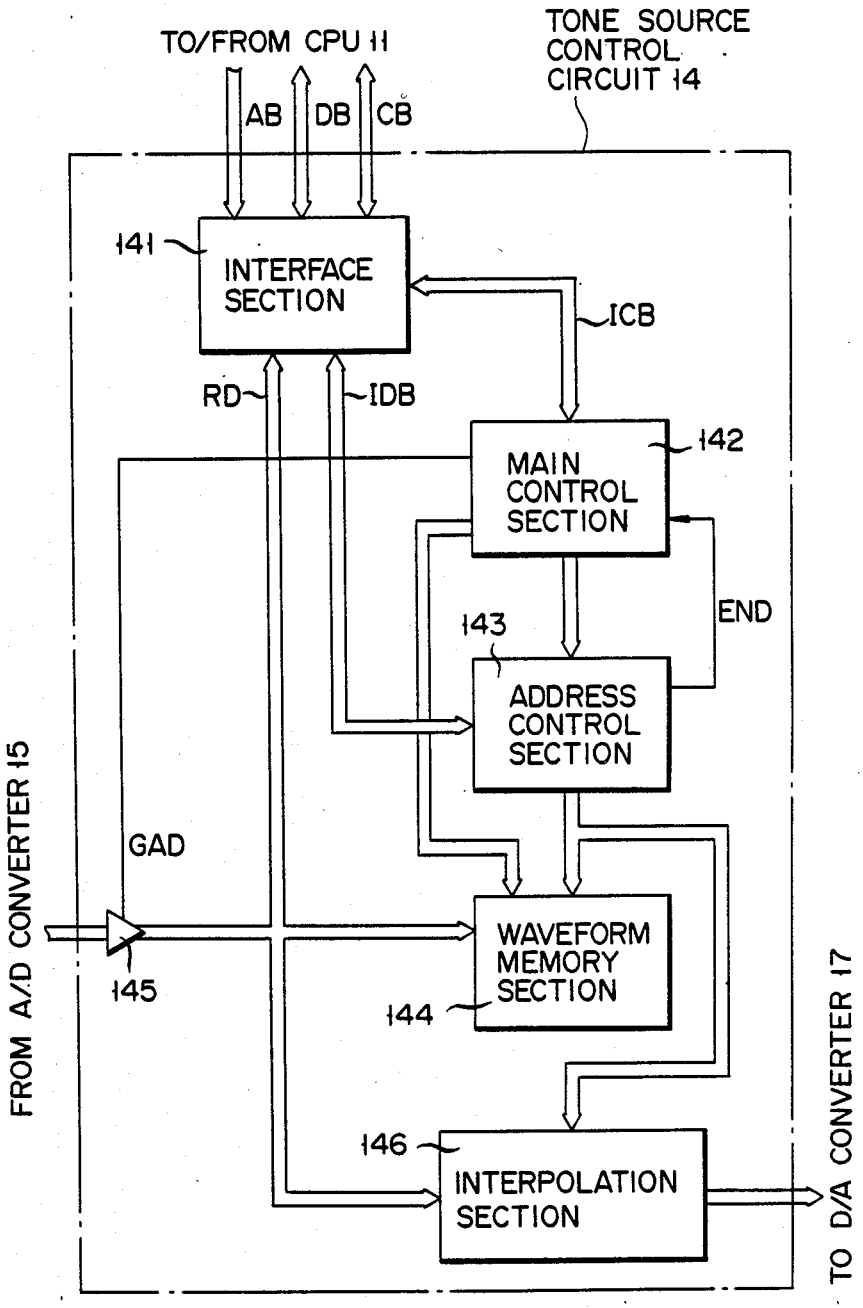
FIG. 2 is a block diagram showing a tone source control circuit shown in FIG. 1.

Now, the detailed construction of the tone source control circuit 14 will be described with reference to FIG. 2. Referring to the Figure, the tone source control circuit 14 includes an interface section 141, a main control section 142, an address control section 143 and a waveform memory section 144 including a RAM and an interpolating section 146. The interface section 141 is coupled with the CPU 11 via the address bus AB, data bus DB and control bus CB, and serves as an interface for data between the CPU 11 and tone source control circuit 14. From the interface section 141 various control signals are fed, through an internal control bus ICB, to the main control section 142. Also, initialization data, such as the first address of a memory in the section 144, and pitch data of the tone to be generated are fed from the interface section 141 to the address control section 143 through an internal data bus IDB. Further, waveform data is transferred between the interface section 141 and waveform memory section 144 via a RAM data bus RD. The RAM data bus RD also serves as a path for both waveform data fed from the A/D converter 15 through a gate 145 and waveform data being fed to the interpolation section 146. The main control section 142 controls the entire tone source control circuit 14.

Figure 3:
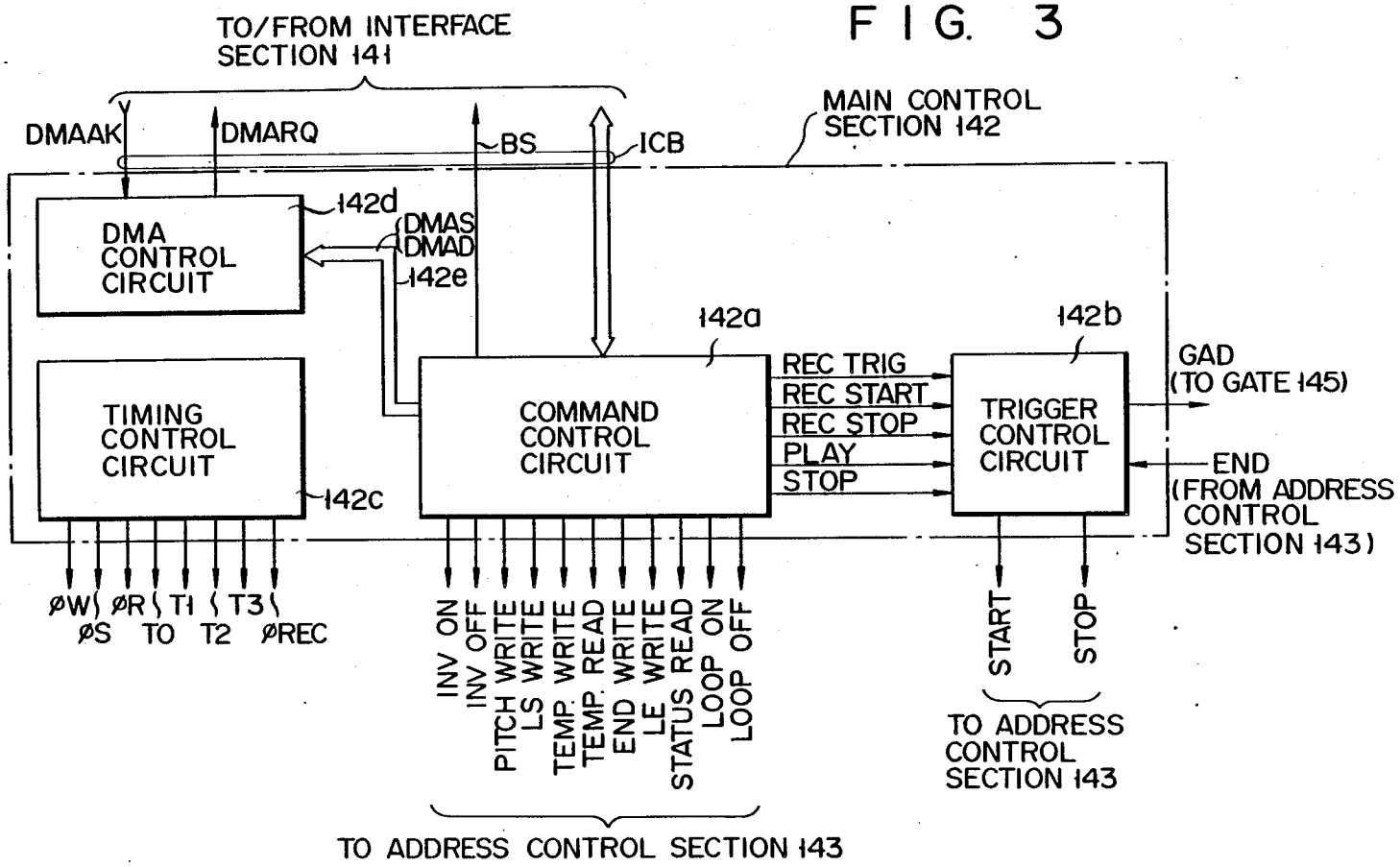
FIG. 3 is a block diagram showing the main control section shown in FIG. 2.
Figure 8:
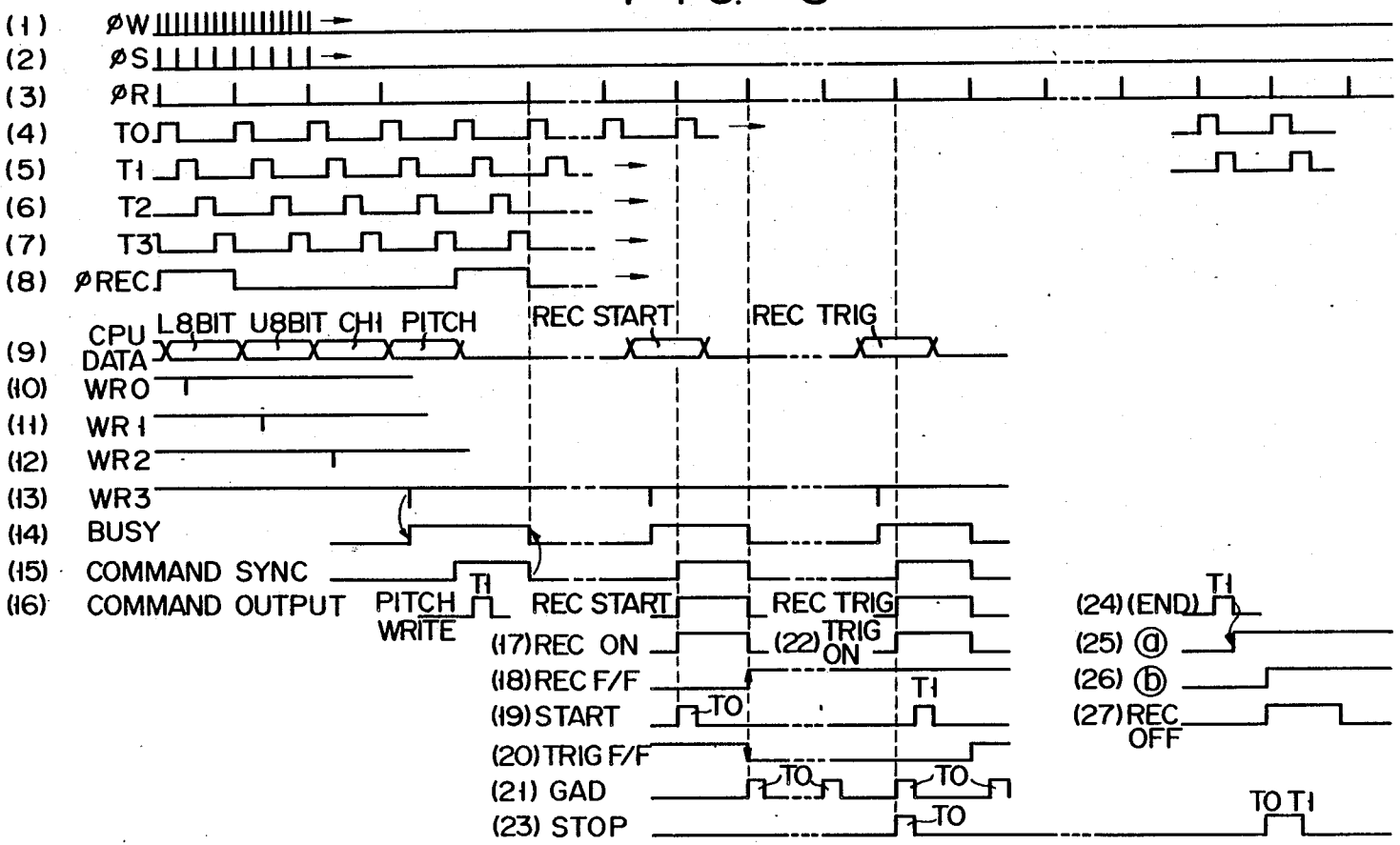
FIG. 8 is a time chart illustrating the operation of the embodiment in relation to FIG. 7.

FIG. 3 shows the main control section 142 in detail. As shown, a control signal fed through the internal control bus ICB is decoded in a command control circuit 142*a* having a decoder construction, and its various commands are then fed to the address control section 143 and an internal trigger control circuit 142*b*. The trigger control circuit 142*b* realizes a delay trigger function of effecting a preliminary recording and a regular recording at the start of recording so as to eliminate the loss of the starting portion of the recorded sound. START and STOP commands are fed from the trigger control circuit 142*b* to the address control section 143, and a gate enable signal GAD is fed to the gate 145. The section 142 further includes a timing control circuit 142*c* which provides various timing signals, including clock signals $\phi_{REC}$ and $\phi_S$ as well as timing signals T0 to T3. FIGS. 8(1) to 8(8) show various timing signals $\phi_W$, $\phi_S$, $\phi_R$, T0 to T3 and $\phi_{REC}$. The section 142 further includes a DMA control circuit 142*d* which provides a DMA request signal DMARQ via an internal control bus ICB and effects DMA control according to a DMA acknowledge signal. A signal DMAD for determining the direction of DMA and a DMA start command DMAS are provided from a command control circuit 142*a* via a line 142*e*. The command control circuit 142*a* also provides a signal BS, which is a switching signal for switching data transfer directions through the data bus DB when data is read into the CPU 11 through the internal control bus ICB.

The address control section 143 designates addresses of a waveform memory 144*a* (to be described later) in the waveform memory section 144. It renews memory addresses under control of the main control section 142 and, when the renewing is done, it feeds an END signal to the trigger control circuit 142*b* of the main control section 142. Address data provided from the address control section 143 includes an integer portion and a decimal fraction portion, data representing the integer portion being fed to the waveform memory section 144, and data representing the decimal fraction portion being fed to the interpolation section 146.

The waveform memory section 144 records waveform data fed from the A/D converter 15 and feeds the stored waveform data to the CPU 11 or to the interpolation section 146 through the RAM data bus RD.

The interpolation section 146 effects linear interpolation of waveform data read out from the waveform memory section 144 and provides the interpolated data to the D/A converter 17.

Figure 4:
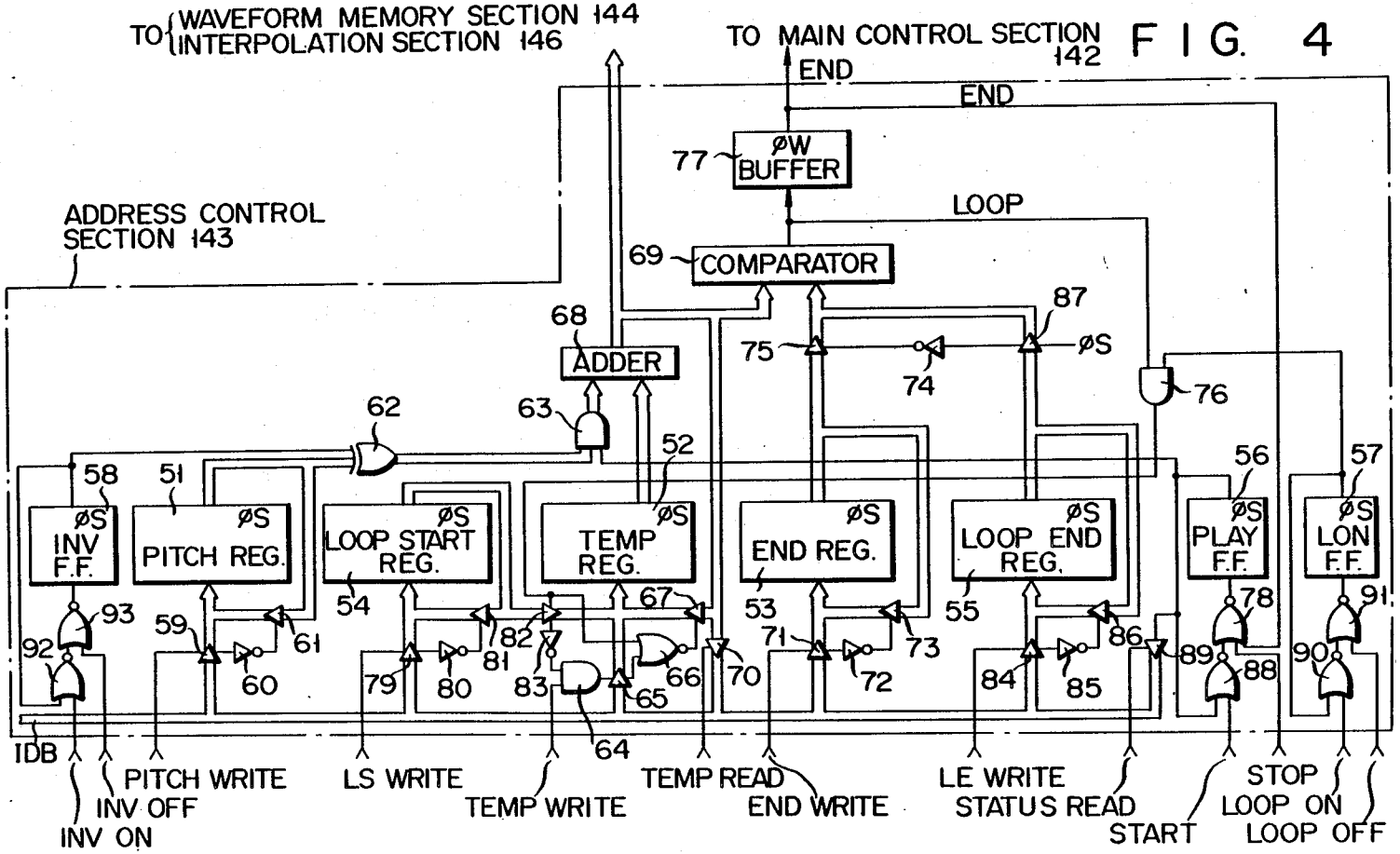
FIG. 4 is a schematic representation of an address control section shown in FIG. 2.

FIG. 4 shows the details of the address control section 143. Referring to the Figure, a pitch register 51 stores pitch data for determining the pitch of the tone to be generated, a temporary storage register 52 stores address data of the waveform memory 144*a*, an end register 53 stores the end value of a renewal of the content of the temporary storage register 52, a loop start register 54 stores start address data of loop designation addresses, a loop end register 55 stores end address data of the loop designation addresses, a play flip-flop 56 controls the start/stop of the renewal of the content of the temporary storage register 52, a loop on/off flip-flop 57 on/off controls loop address designation, and an inverter flip-flop 58 inverts the polarity of each bit of pitch data read out from the pitch register 51. The elements 51 to 58, noted above, all consist of four-stage shift registers for shifting data in synchronism with the timing signal $\phi_S$. In other words, these elements constitute a four-channel four-tone polyphonic structure which is driven on a time division basis at timings T0 to T3. Pitch data is fed to the pitch register 51 via the internal data bus IDB and set therein, as a gate 59 is enabled by a command PITCH WRITE provided from the main control section 142, another gate, gate 61, being disabled through an inverter 60. When the pitch data is set, the output of the inverter 60 is inverted, and the set pitch data is circulated through the gate 61 and fed to an AND gate 63 through an exclusive OR gate 62. Address data is fed to the temporary storage register 52 via the internal data bus IDB, and a command TEMP WRITE, provided from the main control section 142, is fed to a gate 65 through an AND gate 64, as well as to a gate 67 through a NOR gate 66, whereby the address data is set in the temporary storage register 52. The set address data is fed to an adder 68 to be added to pitch data fed through the AND gate 63. The data is also fed to a comparator 69 and, subsequently, returned to the temporary storage register 52 through the gate 67. Seventeen bits constituting the integer portion data of the set address data are provided as address designation data to the waveform memory 144*a*. Meanwhile, thirteen bits constituting the decimal fraction portion of the set address data are provided as interpolation data to the interpolation section 146. Further, when a command TEMP READ is provided from the main control section 142, a gate 70 is enabled so that the content of the temporary storage register 52 is provided to the internal data bus IDB. End address data is fed to the end register 53 through the internal data bus IDB and set therein, as a command END WRITE, provided from the main control section 142, enables a gate 71 and disables a gate 73 through an inverter 72. The set end address data is fed to the comparator 69 through a gate 75, to which the timing signal $\phi_S$ is fed through an inverter 74. The comparator 69 compares end address data from the end register 53 with address data provided from the temporary storage register 52 through the adder 68, and, if the address data from the adder 68 is greater, it provides a signal LOOP. The signal LOOP is fed to an AND gate 76 as well as into a buffer 77 in synchronism with the timing signal $\phi_W$. The output signal of the buffer 77 is fed as an end signal END to both the main control section 142 and a NOR gate 78. Loop start address data is fed to the loop start register 54 via the internal data bus IDB and set therein, as a command LS WRITE, provided from the main control section 142, enables a gate 79 and disables a gate 81 through an inverter 80. The set loop start address data is circulated through the gate 81 and set in the temporary storage register 52 through a gate 82, as the signal LOOP enables a gate 82 through the AND gate 76, disables the AND gate 64 through an inverter 83 and disables the gate 67 through the NOR gate 66. The loop end address data is fed to the loop end register 55 via the internal data bus IDB and set therein, as a command LE WRITE, provided from the main control section 142, enables the gate 84 and disables the gate 86 through the inverter 85. The set loop end address data is circulated through a gate 86 and fed to a comparator 69 through a gate 87, which is enabled by the timing signal $\phi_S$. The data fed to the comparator 69 for comparison with the data of the temporary storage register 52 is the content of the loop end register 55 when the timing signal $\phi_S$ prevails, and the content of the end register 53 in the absence of the timing signal $\phi_S$. The play flip-flop 56 is set when a command START is fed from the main control section 142 to a NOR gate 88, and reset when a command STOP from either the section 142 or the end signal from the buffer 77 is fed to the NOR gate 78. The output of the play flip-flop 56 is returned to the NOR gate 88 and fed to enable the AND gate 63. Further, when a command STATUS READ is provided from the main control section 142, a gate 89 is enabled to pass the output of the play flip-flop 56 to the internal data bus IDB. The loop-on flip-flop 57 is set when a command LOOP ON is fed from the main control section 142 to a NOR gate 90. The output of the loop-on flip-flop 57 is returned to the NOR gate 90 and fed to the AND gate 76. The inverse flip-flop 58 is set when a command IVN ON is fed from the main control section 142 to a NOR gate 92, and reset when a command INV OFF is fed to a NOR gate 93. The output of the inverse flip-flop 58 is returned to the NOR gate 92 and fed to the exclusive NOR gate 62 to cause inversion of the pitch data from the pitch register 51.

Figure 5:
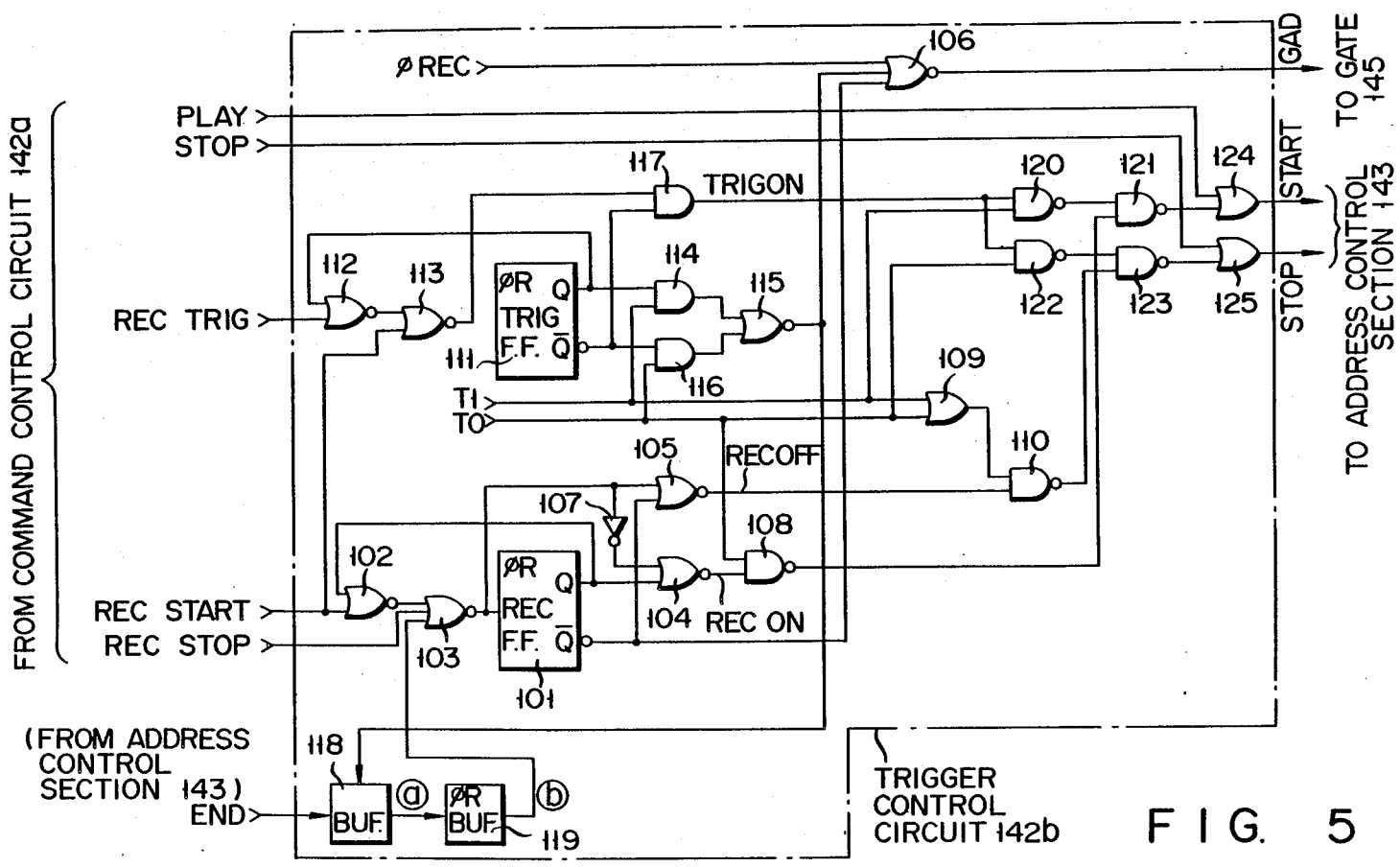
FIG. 5 is a schematic representation of a trigger control circuit shown in FIG. 3.

FIG. 5 shows, in detail, the trigger control circuit **142*b* in the main control section 142. Referring to the Figure, a record flip-flop 101 is set when a command REC START from the command control circuit 142*a* is fed to a NOR gate 102 in synchronism with the timing signal $\phi_R$, and reset when a command REC STOP is fed to a NOR gate 103. The $\overline{Q}$ output of the record flip-flop 101 is returned to the NOR gate 102 and fed through a NOR gate 104 as a signal REC ON. The Q output, conversely, is fed through a NOR gate 105 as a signal REC OFF. The output of the NOR gate 103 is fed to both the NOR gate 105 and the NOR gate 104 through an inverter 107. The signal REC ON is fed to a NAND gate 108 to which the timing signal T0 is fed as one input. The signal REC OFF is fed to a NAND gate 110 to which the timing signal TO or Tl is fed through an OR gate 109. A trigger flip-flop 111 is set when a command REC TRIG is fed from the command control circuit 142*a* to a NOR gate 112 in synchronism with the timing signal $\phi_R$, and reset when the command REC START, noted above, is fed to a NOR gate 113. The Q output of the trigger flip-flop 111 is returned to the NOR gate 112 and fed to a NOR gate 115 through an AND gate 114 to which the timing signal T1 is fed as one input. The $\overline{Q}$ output, in contrast, is fed to a NOR gate 115 through an AND gate 116 to which the timing signal T0 is fed as one input, and is also fed through an AND gate 117 to which the output of the NOR gate 113 is fed as one input, thereby appearing as a signal TRIG ON. The output of the NOR gate 115 is fed to the NOR gate 106, and also fed, as a read signal, to a buffer 118. The buffer 118 receives the END signal from the buffer 77 in the address control section 143, and feeds its output to a buffer 119 under the control of the timing signal $\phi_R$. The output of the buffer 119 is, in turn, fed to the NOR gate 103. The signal TRIG ON, provided from the AND gate 117, is fed to a NAND gate 121 through a NAND gate 120 to which the timing signal T1 is fed as one input, and is also fed to a NAND gate 123 through a NAND gate 122 to which the timing signal T0 is fed as one input. The output of the NAND gate 108 is fed to another input terminal of the NAND gate 121, while the output of the NAND gate 110 is fed to another input terminal of the NAND gate 123. The output of the NAND gate 121 is fed as a START signal to the address control section 143 through an OR gate 124 to which a command PLAY is fed as one input from the command control section 142*a*. The output of the NAND gate 123 is fed as a STOP signal to the address control section 143 through an OR gate 125 to which a command STOP is fed as one input from the command control circuit 142*a*. The timing signal $\phi_{REC}$ is fed to a NOR gate 106 to which the output of the NOR gate 115 and the $\overline{Q}$ output of the record flip-flop 101 are also fed, and the output of the NOR gate 106 is fed as a GAD signal to the gate 145 to enable this gate 145 to lead the waveform data from the A/D converter 15** to the RAM data bus RD.

Figure 6:
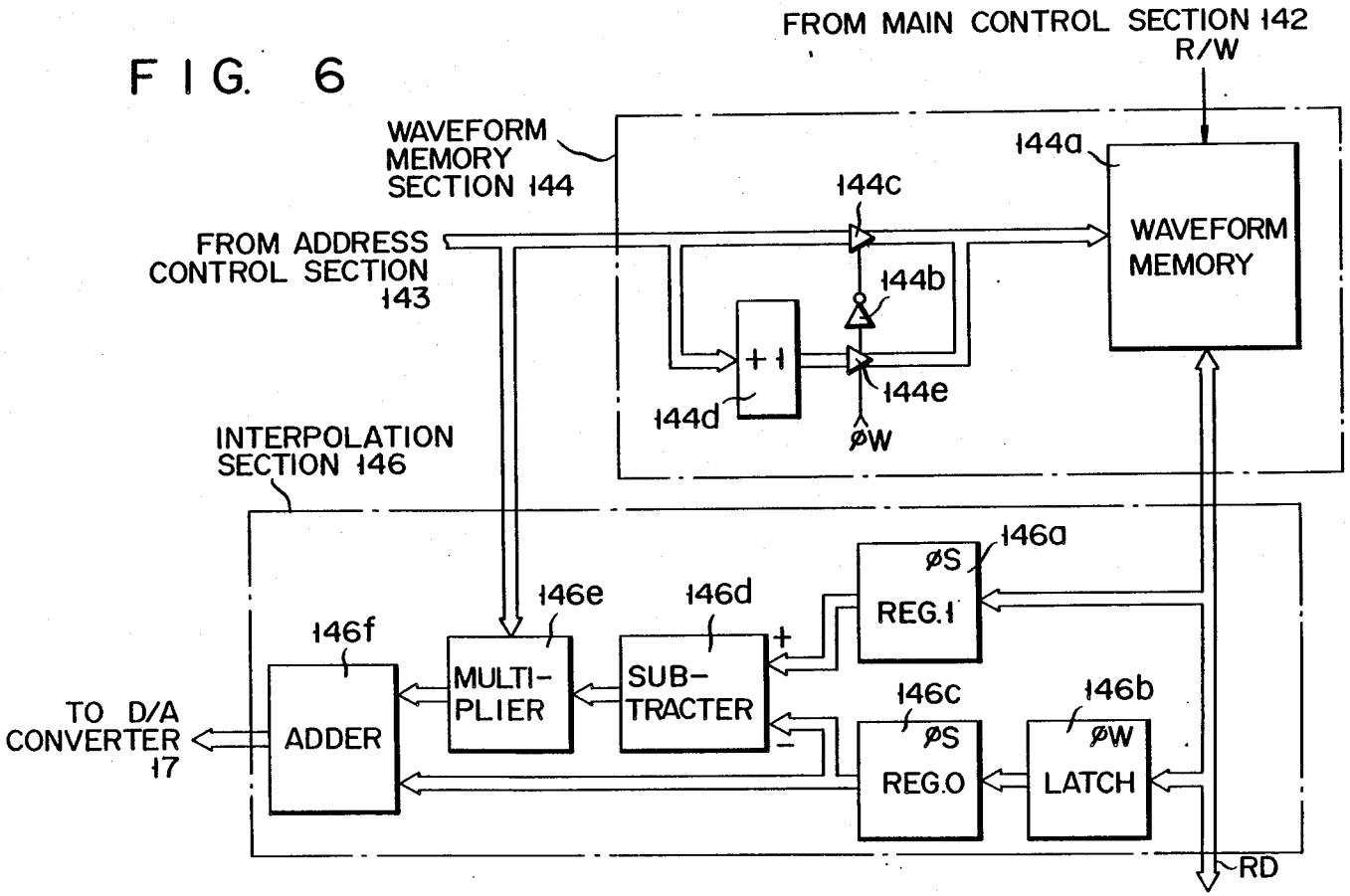
FIG. 6 is a block diagram showing a waveform memory section and an interpolation section shown in FIG. 2.

FIG. 6 shows the waveform memory section 144 and interpolation section 146 in detail. Of the address data provided from the address control section 143, seventeen bits in the integer number portion are fed to a waveform memory **144*a* through a gate 144*c* to which the timing signal $\phi_W$ is fed through an inverter 144*b*, these bits being incremented by +1 by a +1 incrementing circuit 144*d* and fed to the waveform memory 144*a* through a gate 144*e* enabled by the timing signal $\phi_W$. To the waveform memory 144*a* is fed a read/write signal R/W from the main control section 142**.

The waveform data provided from the designated address of the waveform memory **144*a* is fed into a register 146*a* via the RAM data bus RD and in synchronism with the timing signal $\phi_S$. Similarly, it is fed into a latch 146*b* in synchronism with the timing signal $\phi_W$, and then led into a register 146*c* in synchronism with the timing signal $\phi_S$. The data led into the register 146*a* is fed to a subtracter 146*d* for subtraction from it of the data having been fed into the register 146*c*, the difference data being fed to a multiplier 146*e*. To the multiplier 146*e* is also fed the decimal fraction portion of the address data from the address control section 143. The multiplier 146*e* multiplies the decimal fraction data and data from the subtracter 146*d* and feeds the product data to an adder 146*f*. To the adder 146*f* is also fed the output of the register 146*c*. The adder 146*f* adds the two inputs and feeds the sum data to the D/A converter 17 shown in FIG. 1**.

Figure 7:
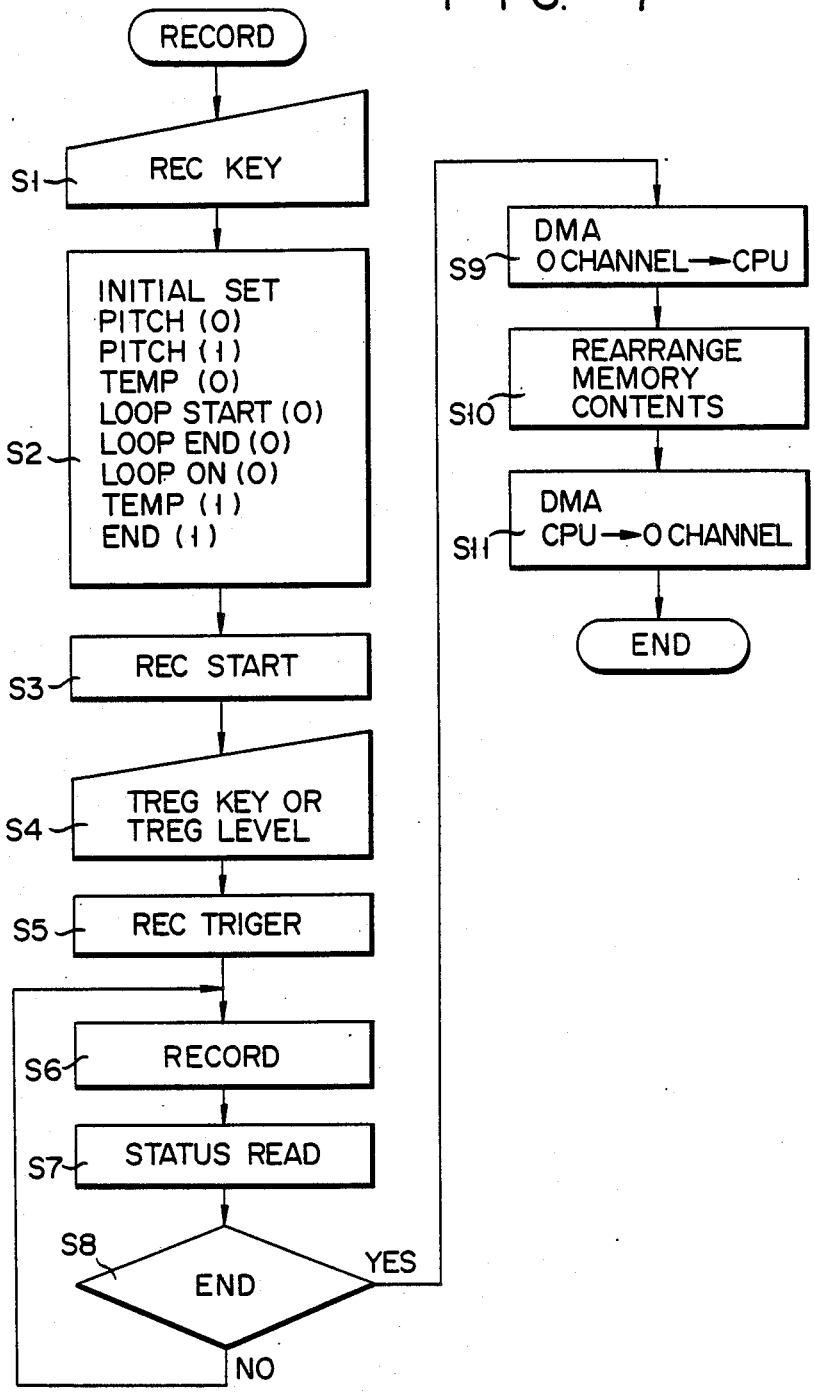
FIG. 7 is a flow chart explaining a recording operation of the embodiment shown in FIGS. 1 to 6.

The operation of the embodiment of the above construction will now be described with reference to FIGS. 7 and 8. FIG. 7 is a flow chart illustrating a record routine. When recording external sound, a record key in the key switch group 13 is first turned on (step S1). Then, given initial data are set, this initial data having been set in advance in the registers 51 to 55. More specifically, the pitch data, start address data, loop start address data, loop end address data, end address data, loop-on data, etc., are fed from the key switch group 13 (step S2). At this time, the CPU 11 feeds the 16-bit data as separate lower (L) and upper (U) 8-bit data, as shown in (9) in FIG. 8. The operation timings of the CPU 11 are asynchronous to the timings in the tone source control circuit 14, as shown in (1) through (8) in FIG. 8. When the pitch data is of channel CH1, for instance, channel CH1 designation data and pitch designation data are provided subsequent to the pitch data, as shown in (9) in FIG. 8. The writing of these data in the tone source control circuit 14 is done under the control of write signals WR0 to WR3, generated from the command control circuit 142*a*, as shown in (10) to (13) in FIG. 8. The upper and lower bit data is fed, through the interface section M1, to the internal data bus IDB in response to the signals WR1, and WR0, respectively, and a BUSY signal, as shown in (8) in FIG. 8, is provided, in response to the signal WR3, from the command control circuit 142*a* to the CPU 11 to inhibit execution of the next instruction. A COMMAND SYNC signal, as shown in (15) in FIG. 8, which is a timing signal for synchronizing the CPU 11 and tone source control circuit 14, rises in the main control section 142 in response to the timing signal $\phi_R$ provided while the BUSY signal prevails. Command output is provided from the main control section 142. The command control circuit 142*a* in the main control section 142 provides a command PITCH WRITE in response to the timing signal T1 (see (16) in FIG. 8). Meanwhile, the COMMAND SYNC signal falls in response to the next timing signal $\phi_R$, and, with this fall, the BUSY signal to fall. When the command PITCH WRITE is provided from the command control circuit 142*a*, the gate 59 in the address control section 143 is enabled so that the pitch data provided to the internal data bus IDB is set, in response to the timing signal $\phi_S$, in the pitch register 51 for channel CH1. The same pitch data setting operation takes place for the other channel registers as well.

It is now assumed that the following initial data are set:

PITCH(0)=0.25
PITCH(1)=0.25
TEMP(0)=00000
LOOP START(0)=00000
LOOP END(0)=01000
LOOP ON(0)=set
TEMP(1)=01000
END(1)=08000 where (0) and (1) represent respective channel numbers, and TEMP represents the temporary storage register 52.

When the setting of the initial data is completed, the CPU 11 generates a record start command (step S3). This record start command is written under the control of the write signal WR3, and the command control circuit 142*a* generates a command REC START at the time of appearance of the COMMAND SYNC signal during the presence of the BUSY signal. The command REC START is fed to the record flip-flop 101 through the NOR gates 102 and 103 in the trigger control circuit 142*b*. The record flip-flop 101 is set in response to the next timing signal $\phi_R$. The Q output of the record flip-flop 101 is thus inverted from "0" to "1" so that a REC ON signal, as shown in (17) in FIG. 8, is generated. The record flip-flop 101 provides the Q output as shown in (18) in FIG. 8. The REC ON signal is fed to the NAND gate 108, the output of which is "0" during the presence of the timing signal T0. The NAND gate output is also fed as a command START (i.e., START signal as shown in (19) in FIG. 8) to the address control section 143 through the NAND gate 121 and OR gate 124. Meanwhile, the command REC START is fed to the trigger flip-flop 111 through the NOR gate 113 to reset the trigger flip-flop 111 in response to the timing signal $\phi_R$. The trigger flip-flop 111 thus provides its Q output as shown in (20) in FIG. 8. The timing signal T0 is fed through the AND gate 116, NOR gate 115 and NOR gate 106 to be fed as gate open signal GAD to the gate 145. Thus, waveform data sampled in the A/D converter 15 is fed through the gate 145 to the RAM data bus RD in response to every T0 timing signal.

The starting command (i.e., START signal) provided from the trigger control circuit 142*b* is fed to the play flip-flop 56 through the NOR gates 88 and 78 in the address control section 143, and set in the play flip-flop 56 in response to the timing signal 100 $_S$. In this state, preliminary recording is started. More specifically, when the play flip-flop 56 is set, its output enables the AND gate 63 so that the pitch data is passed from the pitch register 51 to the adder 68. In the temporary storage register 52 the data "00000" (representing address 0) has been set, while in the pitch register 51 pitch data "0.25" has been set. Thus, the adder 68 progressively adds 0.25 to the content of the temporary storage register 52. The output data of the adder 68 is fed to the waveform memory section 144 to designate successive addresses of the waveform memory 144*a* from the address 0, whereby the waveform data sampled by the A/D converter 15 is successively stored in the designated addresses of the waveform memory 144*a* from the address 0. Meanwhile, data "01000" (representing address 1,000) has been set in the loop end register 55 so that, when the address data output of the adder 68 coincides with 1,000, the comparator 69 provides the LOOP signal. Further, since the loop-on flip-flop 57 has been set, the AND gate 76 is enabled to enable the gate 82 so that the address data "00000" set in the loop start register 81 is transferred to the temporary storage register 52. Subsequently, the address addition operation proceeds again according to the pitch data. In this way, a recording operation is performed by repeatedly designating addresses from the loop start address set in the loop start register 54 until the loop end address set in the loop end register 55 is reached. This recording state is the preliminary recording state.

Subsequently, when a trigger key in the key switch group 13 is operated, or when the recording level exceeds a predetermined level, the CPU 11 provides a command REC TRIGGER (steps S4 and S5 and also see (9) in FIG. 8). This command is written under the control of the write signal WR3, as provided by the command control circuit 142*a*. This command is fed to the trigger flip-flop 111, through the NOR gates 112 and 113 in the trigger control circuit 142*b*, to set the trigger flip-flop 111 in response to the timing signal $\phi_R$. Further, a TRIG ON signal as shown in (22) in FIG. 8 is provided from the AND gate 117 and fed to the NAND gate 122. Thus, the timing signal T0 is fed, as a STOP signal, through the NAND gates 122 and 123, and OR gate 125 to the NOR gate 78 of the address control section 143 to reset the play flip-flop 56 for channel CH0, as shown in (23) in FIG. 8. As a result, the AND gate 63 is disabled to interrupt the address renewal. The TRIG ON signal is also fed to the NAND gate 120, while the timing signal T1 is fed through the NAND gates 120 and 121, and OR gate 124, and provided as the START signal, as shown in (19) in FIG. 8. This START signal is fed to the NOR gate 88 of the address control section 143 to set the play flip-flop for channel CH1.

Since the data "01000" "08000" and "0.25" have been set in the temporary storage register 52, end register 53 and pitch register 51 for the channel CH1, respectively, the address renewing operation is started from address 1,000. That is, waveform data is written from address 1,000 of the waveform memory 144*a* (step S6). This operation is the regular recording operation. The CPU 11 reads out the set status of the play flip-flop 56 by periodically providing a command STATUS READ (step S7). If it detects that the play flip-flop 56 has been set, it judges that recording is in force, so that it refrains from proceeding to the following process (step S8). When the address data from the adder 68 coincides with the address data "08000" from the end register 53, the comparator 69 provides the LOOP signal. At this time, the AND gate 76 is not enabled since the loop-on flip-flop 57 for channel CHl has not been set. Meanwhile, the LOOP signal is written in the buffer 77 and provided as an END signal which is fed to both the NOR gate 78 to reset the play flip-flop 56, and the buffer 118 of the trigger control circuit 142*b* of the main control section 142. The END signal fed to the buffer 118 is written therein in response to the rising of the timing signal T1 provided through the AND gate 114 to which the Q output of "1" is fed from the trigger flip-flop 111, i.e., in response to the falling of the signal T1 said END signal being then written in the buffer 119 in response to the next timing signal $\phi_R$ fed to the NOR gate 103. As a result, the record flip-flop 101 is reset to provide a $\overline{Q}$ output of "1" which is fed through the NOR gate 105 as the REC ON signal (see (25) through (27) in FIG. 8). Thus, the timing signals T0 and T1 are fed from the NAND gate 110 and OR gate 109, and the outputs $\overline{T0}$ and $\overline{T1}$ are thus fed through the NAND gate 123 and OR gate 125 so that the STOP signal will be provided in response to the timing signals T0 and T1 (see (23) in FIG. 8).

The STOP signal is fed to NOR gate 78 in the address control section 143, thus resetting the play flip-flops for both the channels CH0 and CH1. The AND gate 63 is thus disabled to interrupt the address renewing. The CPU 11 reads out the content of the play flip-flop 56 under the control of the command STATUS READ and, if it detects that the flip-flop 56 is reset, it proceeds to the next process.

In the process up to step S8, repeated recording from address 0 to address 1,000 of the waveform memory is done for the channel CH0 (prelimiary recording), while recording is done for channel CH1 (regular recording) from address 1,000 to address 8,000 of the waveform memory 144*a*. In the next process, the preliminary record portion and regular record portion are joined together. More specifically, in step S9 the waveform data recorded in the waveform memory 144*a* from address 0 to address 1,000 for channel CH0 is DMA transferred a memory (not shown) in the CPU 11. That is, the DMA start signal and signal representing the direction of DMA are provided from the command control circuit 142*a* to the DMA control circuit 142*d* (here from the waveform memory 144*a* to the CPU 11), and the DMA control circuit 142*d* provides a DMA request signal RQ to the CPU 11. When the DMA processing is ready to perform completion of the preceding process, the CPU 11 provides the DMA acknowledgement signal AK to cause start of the DMA transfer. In the memory in the CPU 11, the waveform data from address 0 to address 1,000 in the waveform memory 144*a* are stored and rearranged into a correct sequence of data (step S10). If the preliminary recording has terminated at address 600 with the appearance of the loop end signal, recorded data one loop before address 601 to address 1,000 remains. In this case, the data is rearranged into a sequence of data from addresses 601 to 1,000 and data in addresses 0 to 600 in the mentioned order. At this time, the data in the temporary storage register 52 in the address control section 143 is "00600". By setting data "00000" and "01000" in the loop start register 54 and loop end register 55, respectively, and by setting the loop-on register 57, the content of the temporary storage register 52 is updated 601→1,000, 0→600 so that data is read out from the waveform memory 144*a* in the correct sequence. It is also possible to readout data in addresses 0 to 1,000 of the waveform memory 144*a* without condition, as well as to rearrange the readout data in the memory in the CPU 11. To this end, the CPU 11 provides a command TEMP READ to enable the gate 70 to readout the content in the temporary storage register 52. If address 600 is detected, the process noted above is possible. In a subsequent step S11, the content in the memory in the CPU 11 is DMA transferred from addresses 0 to 1,000 of the waveform memory 144*a*.

The recording process is completed in the above way. The reproducing process will now be described. Reproduction may be done in one of two ways, i.e., one in which the reproduction is done at notes corresponding to keys operated on the keyboard 12, or one in which the recorded sound is reproduced as such by operating a monitor switch in the key switch group 13. Here, the former method will be described. First, a reproduce mode is set by depressing a reproduce key in the key switch group 13 such that one of the channels CH0 to CH3 is designated. In the above recording example, the tone waveform data is recorded in addresses 0 to 8,000 for channel CH1. Therefore, channel CH1 is designated, and initial data "00000" and "08000" are set in the temporary storage register 52 and end register 53, respectively, this data setting operation being the same as in the case of recording. Then, pitch data is set in the pitch register 51 by depressing a key on the keyboard 12. When the CPU 11 provides a reproduce command, the command control circuit 142*a* of the main control section 142 provides a command PLAY. The command PLAY is fed to the address control section 143 through the OR gate 124 of the trigger control circuit 142*b* to set the play flip-flop 56 through the NOR gates 88 and 78 in synchronism with the timing signal $\phi_S$. With the setting of the play flip-flop 56, the AND gate 63 is enabled so that address data in the temporary storage register 52 is renewed according to the pitch data set in the pitch register 51, as in the case of recording. If the inverse flip-flop 58 has been set by the command INV ON at this time, a "1" signal is fed from the inverse flip-flop 58 to the exclusive OR gate 62. Thus, the data provided from the pitch register 51 through the exclusive OR gate 62 is inverted, and a complement to the pitch data is added to the data of the temporary storage register 52 in the adder 68, i.e., subtraction is done. It is thus possible to produce-inverse reproduction from the waveform memory 144*a*. The resetting of the inverse flip-flop 58 is done under the control of the command INV OFF.

Of the address data provided from the adder 68, the integer number portion of 17 bits is fed to the waveform memory 144, and the decimal fraction portion of 13 bits is fed to the interpolation section 146. The address data fed to the waveform memory section 144 is incremented by +1 in the +1 incrementing circuit 144*d* in response to the timing signal $\phi_W$. The incremented data designates the corresponding address of the waveform memory 144*a*, while it also designates as such the corresponding address of the waveform memory 144*a* in response to the timing signal $\phi_W$. That is, an address in question and the next address are designated in a time division fashion. The waveform data read out from the waveform memory 144*a* is fed through the RAM data bus RD, and, in synchronism with the timing signal $\phi_W$, the waveform data in the +1-incremented address is set in the latch 146*b*. In synchronism with the next timing signal $\phi_S$, the data in the latch 146*b* is written in the register 146*c*, and the waveform data read out under the control of the address data which is not incremented by +1 is written in the register 146*b*. In the subtracter 146*d*, the content of the register 146*c* is subtracted from the content of the register 146*a*. The difference data is multiplied in the multiplier 146*e* by the decimal fraction portion of the address data from the address control section 143, whereby the ratio of the decimal fraction portion to the waveform data is designated by the integer number portion of the address data. The output of the subtracter 146*d* is added in the adder 146*f* to the data stored in the register 146*c* to effect linear interpolation. The output of the adder 146*f* is fed to the D/A converter 17 which converts the input digital waveform data into a corresponding analog value that is fed through the VCA 18-1, which has been rendered operative with the designation of channel CH1, to the tone output terminal 19-1. When the key is depressed prolongedly, the sound is stopped upon completion of a reading of all the stored waveform data, if the loop-on flip-flop 56 is not set. If the loop-on flip-flop 56 is set and suitable data are set in the loop start register 54 and loop end register 55, the sound is continued for the duration during which the key is depressed. By resetting the loop-on register 57 when the key is released, all the waveform data is read out before the stop.

As has been described in the foregoing, according to the invention, an address control logic is provided which effects waveform memory address control under the sole control of commands such as start and end commands from the CPU. The address control logic thus relieves the burden on the CPU in the recording and reproduction of external sound. In addition, a polyphonic arrangement may be obtained by constructing shift registers, each having a plurality of stages as a temporary storage register for storing addresses of the waveform memory: an end register for storing the end address, a loop start register for storing the loop start address, a loop end register for storing the loop end address, a pitch register for storing the pitch data, etc., these registers being driven on a time division basis. A polyphonic system can be realized without increase of components or cost.

Further, since the preliminary recording is done repeatedly before regular recording and the regular recording is initiated by the start of trigger recording, there is no possibility of an interruption at the start of recording, thereby eliminating a wasteful non-recorded portion.

Furthermore, it is possible to permit reproduction in one channel while recording is made in a different channel, just as it is also possible to obtain mixing, i.e., recording the reproduced sound.

The digital waveform signal used in the described embodiment is formed by PCM processing. The digital waveform signal, however, may also be formed by any known pulse modulation method.

What is claimed is:

1. An electronic musical instrument, comprising:

analog-to-digital converting means for converting an analog external sound signal into a digital waveform signal which represents a waveform corresponding to the waveform of said analog external sound signal;

memory means for storing the digital waveform signal output from said analog-to-digital converting means;

digital-to-analog converting means for converting the digital waveform signal output from said memory means into an analog sound signal having a waveform determined by said digital waveform signal;

pitch designating means for designating a pitch of the sound produced based on the analog sound signal derived from said digital-to-analog converting means;

address control logic circuit means coupled to said memory means for designating memory addresses for writing and reading the digital waveform signal; and control means coupled to said address control logic circuit means and to said pitch designating means for supplying to said address control logic circuit means record and reproduce commands for writing and reading said digital waveform signal in and from the memory means, and for instructing said address control logic circuit means to designate a memory address with a speed determined by said pitch designating means when the digital waveform signal is read out from said memory means, so that a sound having a waveform determined by the read out digital waveform signal and a frequency determined by said pitch designating means can be reproduced.

2. The electronic musical instrument according to claim 1, wherein said address control logic circuit means includes:

a temporary storage register means for storing addresses of said memory means;

renewal means for renewing the content of said temporary storage register means;

a pitch register means for storing pitch data designated by said pitch designating means for determining the renewal speed of said renewal means;

an end register means for storing the end address of said renewed content;

comparing means for comparing the content of said temporary storage register means and the content of said end register means and providing an end signal to said renewal means when the content of said temporary storage register means coincides with or exceeds the content of said end register; and control register means for controlling the continuation and termination of the renewal operation of said renewal means according to commands from said control means.

3. The electronic musical instrument according to claim 2, wherein each of the temporary storage register means, end register means, pitch register means and control register means in said address control logic circuit means has a plurality of memory stages arranged to be operative on a time division basis.

4. The electronic musical instrument according to claim 2, wherein said address control logic circuit means includes providing means for providing a complement of pitch data stored in said pitch register means to said renewal means to cause said renewal means to complement update the content of said temporary storage register means.

5. The electronic musical instrument according to claim 2, wherein said control means includes a CPU, a command control circuit for providing a plurality of commands according to commands from said CPU, and supplying means for supplying said plurality of commands to said address control logic circuit means.

6. The electronic musical instrument according to claim 1, wherein said control means includes a CPU, and said address control logic circuit means includes a temporary storage register means for storing addresses of said memory means, a renewal means for renewing the content of said temporary storage register means, a pitch register means for storing the pitch data for determining the renewal speed of said renewal means, an end register means for storing the end address of said renewed content, a flip-flop for controlling loop designation of the address of said memory means, a loop end register means for storing the end address of the loop designation, first comparing means for comparing the content of said temporary storage register means and the content of said loop end register means and providing a loop end signal to cause transfer of the content of said loop start register means to said temporary storage register means when the content of said temporary storage register means coincides with or exceeds the content of said loop end register means, second comparing means for comparing the content of said temporary storage register means and the content of said end register means and providing an end signal to said renewal means when the content of said temporary storage register means coincides with or exceeds the content of said end register means, and renewal operation control means having a flip-flop for controlling the continuation and termination of the renewal operation of said renewal means according to commands from said CPU.

7. An electronic musical instrument, comprising:

waveform memory means for storing tone waveform data;

sampling means for sampling external sound and writing sampled data as digital waveform data in said waveform memory means, said sampling means including analog-to-digital converting means for converting an analog external sound signal representing said external sound, into digital waveform data corresponding to the waveform of said external sound analog signal;

digital-to-analog converting means for converting the digital waveform data output from said waveform memory means into an analog sound signal having a waveform determined by said digital waveform data;

pitch designating means for designating a pitch of the sound produced based on the analog sound signal derived from said digital-to-analog converting means;

first reading means for reading out the tone waveform data stored in said waveform memory means at a rate according to the pitch designated by said pitch designating means;

control means; and address control logic circuit means for designating addresses of said waveform memory means according to commands from said control means, first designating means for repeatedly designating a predetermined address area of said waveform memory means as write addresses according to a preliminary record command from said control means; and second designating means for designating a different address area of said waveform memory means as write addresses according to a regular record command from said control means.

8. The electronic musical instrument according to claim 7, which further comprises:

stopping means for stopping the address renewal according to said preliminary record command when said regular record command is provided from said control means;

rearranging means for rearranging, into a correct sequence, the waveform data in said waveform memory means at the instant of the termination of said address renewal; and second reading means for successively and continuously reading out rearranged preliminary and regular record data.

9. The electronic musical instrument according to claim 7, wherein said first reading means for reading tone waveform data includes interpolation means for interpolating the tone waveform data read out from said waveform memory means by said second reading means.

10. The electronic musical instrument according to claim 7, wherein said address control logic circuit means includes addressing means for generating address data consisting of an integer number portion and a decimal fraction portion, effecting means for effecting the writing and reading of waveform data by designating addresses of said waveform memory means according to the integer number portion of said address data, first forming means for forming interpolated data with respect to the waveform data read out from said waveform memory means according to the integer number portion of said address data, and second forming means for forming a tone signal by combining said read out waveform data and interpolated data.

11. The electronic musical instrument according to claim 7, wherein said control means includes a CPU.

12. An electronic musical instrument, comprising:

analog-to-digital converting means for converting an external sound signal into a digital waveform signal;

memory means for storing said digital waveform signal;

address control logic circuit means for designating memory addresses for writing and reading the digital waveform signal; and control means for supplying to said address control logic circuit means record and reproduce commands for writing and reading said digital waveform signal in and from said memory means;

wherein said address control logic circuit means includes:

temporary storage register means for storing addresses of said memory means;

renewal means for renewing the content of said temporary storage register means;

pitch register means for storing pitch data for determining the renewal speed of said renewal means;

end register means for storing the end address of said renewed content;

comparing means for comparing the content of said temporary storage register means and the content of said end register means, and for providing an end signal to said renewal means when the content of said temporary storage register means coincides with or exceeds the content of said end register;

control register means for controlling the continuation and termination of the renewal operation of said renewal means according to commands from said control means; and providing means for providing a complement of pitch data stored in said pitch register means to said renewal means, for causing renewal means to complement update the content of said temporary storage register means.

13. The electronic musical instrument according to claim 12, wherein the temporary storage register means, end register means, pitch register means and control register means in said address control logic circuit means each include a plurality of stages arranged to be operative in response to a designation signal on a time division basis.

14. The electronic musical instrument according to claim 12, wherein said control means includes a CPU, a command control circuit for providing a plurality of commands according to commands from said CPU, and supplying means for supplying said plurality of commands to said address control logic circuit means.

15. An electronic musical instrument, comprising:

analog-to-digital converting means for converting an external sound signal into a digital waveform signal;

memory means for storing said digital waveform signal;

address control logic circuit means for designating memory addresses for writing and reading the digital waveform signal; and control means for supplying to said address control logic circuit means record and reproduce commands for writing and reading said digital waveform signal in and from said memory means;

wherein said control means includes a CPU, and said address control logic circuit means includes temporary storage register means for storing addresses of said memory means, renewal means for renewing the content of said temporary storage register means, pitch register means for storing the pitch data for determining the renewal speed of said renewal means, end register means for storing the end address of said renewed content, a flip-flop for controlling loop designation of the address of said memory means, loop end register means for storing the end address of the loop designation, first comparing means for comparing the content of said temporary storage register means and the content of said loop end register means, and for providing a loop end signal to cause transfer of the content of said loop start register means to said temporary storage register means when the content of said temporary storage register means coincides with or exceeds the content of said loop end register means, second comparing means for comparing the content of said temporary storage register means and the content of said end register means, and for providing an end signal to said renewal means when the content of said temporary storage register means coincides with or exceeds the content of said end register means, and renewal operation control means including a flip-flop for controlling the continuation and termination of the renewal operation of said renewal means according to commands from said CPU.

16. An electronic musical instrument, comprising:

waveform memory means for storing tone waveform data;

sampling means for sampling external sound and writing sampled data as waveform data in said waveform memory means;

first reading means for reading out the tone waveform data stored in said waveform memory means;

control means; and address control logic circuit means for designating addresses of said waveform memory means according to commands from said control means, said address control logic circuit means including:

first designating means for repeatedly designating a predetermined address area of said waveform memory means as write addresses according to a preliminary record command from said control means, and second designating means for designating a different address area of said waveform memory means as write addresses according to a regular record command from said control means;

addressing means for generating address data comprised of an integer number portion and a decimal fraction portion, effecting means for effecting the writing and reading of waveform data by designating addresses of said waveform memory means according to the integer number portion of said address data, and wherein said first reading means includes first forming means for forming interpolated data according to the decimal fraction portion of said address data with respect to the waveform data read out from said waveform memory means according to the integer number portion of said address data, and second forming means for forming a tone signal by combining said read out waveform data and said interpolated data.

17. The electronic musical instrument according to claim 16, which comprises:

stopping means for stopping the address renewal operation according to said preliminary record command when said regular record command is provided from said control means;

rearranging means for rearranging, into a correct sequence, the waveform data in said waveform memory means at an instant of termination of said address renewal; and second reading means for successively and continuously reading out rearranged preliminary and regular record data.

* * * * *

REEXAMINATION CERTIFICATE (1004th)

United States Patent [19]

Hanzawa et al.

[11] B1 4,667,556

[45] Certificate Issued Jan. 24, 1989

[54] ELECTRONIC MUSICAL INSTRUMENT WITH WAVEFORM MEMORY FOR STORING WAVEFORM DATA BASED ON EXTERNAL SOUND

[75] Inventors: Kohtaro Hanzawa; Shigenori Morikawa; Hiroshi Morokuma; Hiroyuki Sasaki, all of Tokyo, Japan

[73] Assignee: Casio Computer Co., Ltd., Tokyo, Japan

Reexamination Request:
No. 90/001,557, Jul. 13, 1988

Reexamination Certificate for:

| | |
|---|---|
| Patent No.: | **4,667,556** |
| Issued: | **May 26, 1987** |
| Appl. No.: | **760,291** |
| Filed: | **Jul. 29, 1985** |

[30] Foreign Application Priority Data

Aug. 9, 1984 [JP] Japan ..... 59-167119

[51] Int. Cl.[4] ..... G10H 3/00; G10H 7/00

[52] U.S. Cl. ..... 84/1.01; 84/1.28

[58] Field of Search ..... 84/1.01, 1.03, 1.28, 84/462, DIG. 29

[56] References Cited

U.S. PATENT DOCUMENTS

| | | | |
|---|---|---|---|
| 3,539,701 | 11/1970 | Milde | 84/1.28 |
| 3,652,776 | 3/1972 | Milde, Jr. | 84/1.28 |
| 4,305,319 | 12/1981 | Linn . | |
| 4,383,462 | 5/1983 | Nagai et al. . | |
| 4,433,434 | 2/1984 | Mozer | 84/1.01 X |
| 4,435,831 | 3/1984 | Mozer | 84/1.01 X |
| 4,442,745 | 4/1984 | Gross . | |
| 4,461,199 | 7/1984 | Hiyoshi et al. . | |
| 4,463,650 | 8/1984 | Rupert | 84/1.01 X |
| 4,502,361 | 3/1985 | Vitanen . | |
| 4,539,884 | 9/1985 | Aoki . | |
| 4,614,983 | 9/1986 | Usami | 84/1.01 X |

FOREIGN PATENT DOCUMENTS

| | | |
|---|---|---|
| 51-78219 | 7/1976 | Japan . |
| 54-161313 | 12/1979 | Japan . |
| 55-28072 | 2/1980 | Japan . |
| 55-12542 | 2/1980 | Japan . |
| 55-166698 | 12/1980 | Japan . |

*Primary Examiner*—Stanley J. Witkowski

*Attorney, Agent, or Firm*—Stephen H. Frishauf; Leonard Holtz; Herbert H. Goodman

[57] ABSTRACT

A CPU supplies data write and read commands to only an address control section, and the address control section then designates, for the purpose of writing and reading data, addresses of a waveform memory in which external sound waveform data is stored.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 7–14, 16 and 17 is confirmed.

Claims 2 and 6 are cancelled.

Claims 1, 3–5 and 15 are determined to be patentable as amended.

New claim 18 is added and determined to be patentable.

1. An electronic musical instrument, comprising:

analog-to-digital converting means for converting an analog external sound signal into a digital waveform signal which represents a waveform corresponding to the waveform of said analog external sound signal;

memory means for storing the digital waveform signal output from said analog-to-digital converting means;

digital-to-analog converting means for converting the digital waveform signal output from said memory means into an analog sound signal having a waveform determined by said digital waveform signal;

pitch designating means for designating a pitch of the sound produced based on the analog sound signal derived from said digital-to-analog converting means;

address control logic circuit means coupled to said memory means for designating memory addresses for writing and reading the digital waveform signal; and control means coupled to said address control logic circuit means and to said pitch designating means for supplying to said address control logic circuit means record and reproduce commands for writing and reading said digital waveform signal in and from the memory means, and for instructing said address control logic circuit means to designate a memory address with a speed determined by said pitch designating means when the digital waveform signal is read out from said memory means, so that a sound having a waveform determined by the read out digital waveform signal and a frequency determined by said pitch designating means can be reproduced, *and*

*wherein said address control logic circuit means includes temporary storage register means for storing addresses of said memory means; renewal means for renewing the content of said temporary storage register means; pitch register means for storing the pitch data for determining the renewal speed of said renewal means; end register means for storing the end address of said renewed content; comparing means for comparing the content of said temporary storage register means and the content of said end register means and for providing an end signal to said renewal means when the content of said temporary storage register means coincides with or exceeds the content of said end register means to control the continuation and stop of the renewal operation of renewal means; addressing means for generating address data comprised of an integer number portion and a decimal fraction portion; effecting means for effecting the writing and reading of waveform data by designating addresses of said memory means according to the integer number portion of said address data; and reading means including first forming means for forming interpolated data according to the decimal fraction portion of said address data and second forming means for forming a tone signal by combining said read out waveform data and said interpolated data.*

3. The electronic musical instrument according to claim [2] *1*, wherein each of the temporary storage register means, end register means, pitch register means and control register means in said address control logic circuit means has a plurality of memory stages arranged to be operative on a time division basis.

4. The electronic musical instrument according to claim [2] *1*, wherein said address control logic circuit means includes providing means for providing a complement of pitch data stored in said pitch register means to said renewal means to cause said renewal means to complement update the content of said temporary storage register means.

5. The electronic musical instrument according to claim [2] *1*, wherein said control means includes a CPU, a command control circuit for providing a plurality of commands according to commands from said CPU, and supplying means for supplying said plurality of commands to said address control logic circuit means.

15. An electronic musical instrument, comprising:

analog-to-digital converting means for converting an external sound signal into a digital waveform signal;

memory means for storing said digital waveform signal;

address control logic circuit means for designating memory addresses for writing and reading the digital waveform signal; and control means for supplying to said address control logic circuit means record and reproduce commands for writing and reading said digital waveform signal in and from said memory means;

wherein said control means includes a CPU, and said address control logic circuit means includes temporary storage register means for storing addresses of said memory means, renewal means for renewing the content of said temporary storage register means, pitch register means for storing the pitch data for determining the renewal speed of said renewal means, end register means for storing the end address of said renewed content, a flip-flop for controlling loop designation of the address of said memory means, *loop start register means for storing the start address of the loop designation,* loop end register means for storing the end address of the loop designation, first comparing means for comparing the content of said temporary storage register means and the content of said loop end register means, and for providing a loop end signal to cause transfer of the content of said loop start register means to said temporary storage register means when the content of said temporary storage register means coincides with or exceeds the content of said loop end register means, second comparing means for comparing the content of said temporary storage register means and the content of said end register means, and for providing an end signal to said renewal means when the content of said temporary storage register means coincides with or exceeds the content of said end register means, and renewal operation control means including a flip-flop for controlling the continuation and termination of the renewal operation of said renewal means according to commands from said CPU.

*18. The electronic musical instrument according to claim 1, wherein said electronic musical instrument further comprises control register means for controlling loop designation of the address of said memory means, loop start register means for storing the start address of the loop designation, loop end register means for storing the end address of the loop designation, another comparing means for comparing the content of said temporary storage register means and the content of said loop end register means, and for providing a loop end signal to cause transfer of the content of said loop start register means to said temporary storage register means when the content of said temporary storage register means coincides with or exceeds the content of said loop end register means.*

* * * * *